United States Patent [19]

Weisbach

[11] Patent Number: 4,904,111

[45] Date of Patent: Feb. 27, 1990

[54] ADJUSTABLE SUPPORT FOR USE WITH METAL KEYWAY FORMS FOR ABOVE GRADE CONCRETE SLAB

[75] Inventor: Albert P. Weisbach, Louisville, Ky.

[73] Assignee: Cardinal Manufacturing Co., Louisville, Ky.

[21] Appl. No.: 312,740

[22] Filed: Feb. 21, 1989

[51] Int. Cl.[4] ..... E01C 11/06; E01C 11/04

[52] U.S. Cl. ..... 404/48; 404/50; 404/87; 249/9

[58] Field of Search ..... 404/47-51, 404/87; 52/365; 249/3, 9; 248/188.2, 188.5, 188.8, 688

[56] References Cited

U.S. PATENT DOCUMENTS

| | | | |
|---|---|---|---|
| 2,197,278 | 4/1940 | Sverdahl | 52/365 X |
| 4,022,437 | 5/1977 | French | 249/3 X |
| 4,455,104 | 6/1984 | Weisbach | 404/50 |
| 4,826,117 | 5/1989 | Bastian et al. | 248/188.2 |

*Primary Examiner*—Jerome W. Massie, IV
*Assistant Examiner*—Matthew Smith
*Attorney, Agent, or Firm*—Scott R. Cox

[57] ABSTRACT

This invention discloses an adjustable support securable to metal decking to support a metal keyway form. The adjustable support can be used to establish keyway in concrete poured above ground level, particularly on metal decking. This method of producing a keyway in concrete on metal decking is a vast improvement over previous art and provides a secure, easy, inexpensive method of producing the keyway.

7 Claims, 2 Drawing Sheets

ADJUSTABLE SUPPORT FOR USE WITH METAL KEYWAY FORMS FOR ABOVE GRADE CONCRETE SLAB

BACKGROUND OF INVENTION

1. Field of Invention

This invention relates to metal keyway forms for use in the laying of concrete. In particular, this invention relates to an adjustable support which is securable to metal decking for the support of metal keyway forms.

2. Prior Art

Concrete is used for flooring in most major buildings because of its strength, durability and reliability. However, because concrete tends to expand and contract depending on the temperature, concrete slabs frequently crack once they have dried. In addition to cracking, concrete tends to buckle and rise at the point of any fractures caused by the cracking of concrete slabs.

To allow for expansion and contraction, while at the same time preventing the vertical displacement of the concrete, metal divider strips adapted to form a keyway between two adjacent concrete slabs have been developed. Many different forms of these sheet metal keyways have been provided including, for example, those disclosed in U.S. Pat. Nos. 4,516,875, 4,455,104, 4,443,981, 4,411,404, 4,012,024, 3,770,237, 3,628,764, 3,561,721, 3,288,042 and 3,057,269. Each of these patents discloses a slightly different keyway forming member or some improvement or modification to a keyway form.

These keyway forms have been used exclusively to form keyways in concrete slab on the ground or earth. In setting up the keyway forms before pouring the concrete, vertical stakes are driven into the ground or subground and arranged with their upper ends near the proposed height of the concrete slab. These stakes are provided with some means of attachment to the keyway forms to hold the forms at a preset height. These means for attachment of the stake to the keyway form have also been the subject of numerous patents including for example, U.S Pat. Nos. 4,516,875, 4,455,104, 4,411,404, 4,012,024, 3,784,313, 3,770,237, 3,628,764, 3,561,721, 3,401,612, 3,288,042 and 3,057,269.

While these patents provide a method for forming a metal keyway in concrete poured on the ground, none disclose a keyway form for use in buildings where metal decking is used as the support for the concrete floor. Conventionally, three methods have been used for forming concrete slabs on metal decking. The first is merely the use of wood, usually in the shape of two-by-fours to establish the area in which the slab is poured. The wood is secured in the location desired on the metal decking and the concrete is poured up against it. Sometimes if a keyway is desired, a second piece of wood is secured against the first piece of wood and the concrete is poured over that portion to create the key. While this somewhat crude method has frequently been used, it is labor intensive and time consuming since after the concrete is poured, all of the wood must be removed which requires the chipping away of concrete from the wood forms. Further, concrete can only be poured on one side of the wood at a time thereby increasing the time necessary for the pouring of the concrete floor.

A second commonly used method does not form a keyway at all, but rather is used merely as an accessory to the screeding of the concrete. This procedure requires the placement of screed chairs or pedestals with piping or wood braces running in the opening of the pedestal. The concrete is poured up to the point of the piping, screeded by using the pipe as a base and allowed to set. The pipe is then removed and reused in other concrete laying operations. While this procedure allows for the efficient screeding of the concrete, it does not form any type of key-joint and it does require a good deal of labor to remove the piping with the excess concrete dried up against it.

The third method for pouring concrete on metal decking requires the use of pre-set concrete forms. See for, example, the screed rails sold by VM Permaban, Inc. A generally I-shaped concrete form is placed on the metal decking in the location required for the concrete slab. The concrete form is carefully located on the decking so that the height of the floor is precisely controlled. Once the concrete form is placed on the decking, it is secured to the decking at a few locations by pouring concrete under the form. The concrete form must then be tapped down to assure that the concrete floor to be poured will be flat and the concrete allowed to set. Only then can the main concrete slab be poured. While these concrete forms can be used for the pouring of concrete slabs on metal decking, they have several significant deficiencies since they are brittle, expensive, and take a significant amount of set up time because of the difficulty in locating them precisely on the floor and the delays caused after the initial pouring of concrete to secure the forms in place.

Therefore it is the object of this invention to provide an easy, inexpensive method of securing a metal keyway form to metal decking.

It is another object of this invention to provide a metal decking support which is adjustable to provide various heights to a metal keyway form.

It is a still further object of this invention to provide an adjustable metal decking support which is inexpensive to produce, and easy to secure to metal decking.

These and other objects and features of the present invention will become apparent to those skilled in the art from a consideration of the following detailed description, drawings and claims. The description along with the accompanying drawings provide a selected example of construction of the device to illustrate the invention.

SUMMARY OF THE INVENTION

In accordance with the present invention, there is provided an adjustable support securable to metal decking to support a metal keyway form comprising:

a. a generally flat rectangular metal strip containing a plurality of ridges running vertically the length of the strip, a plurality of closely spaced serrations across the top portion of the ridges and a securing means opening located in the lower portion of the strip;

b. a generally L-shaped support member containing an elongated vertical oval opening and a plurality of valleys on the back of the member which align with the ridges of the metal strip; and c. a means for securing the L-shaped support member to the metal strip through the elongated vertical oval opening in the L-shaped support member and the securing means opening in the metal strip.

This adjustable support which is attachable to a metal keyway form for use with metal decking provides an easy, inexpensive means for securing a metal keyway form to metal decking to allow for the simultaneous formation of two adjacent concrete slabs with a keyway between them on metal decking. Because of the simplicity and strength of the support, it can be easily installed, adjusted to create an accurate height and secured to allow for the pouring and screeding of a concrete floor on metal decking.

BRIEF DESCRIPTION OF THE DRAWINGS

The invention will now be described with reference to the accompanying drawings in which.

DETAILED DESCRIPTION OF PREFERRED EMBODIMENT

Figure 1:
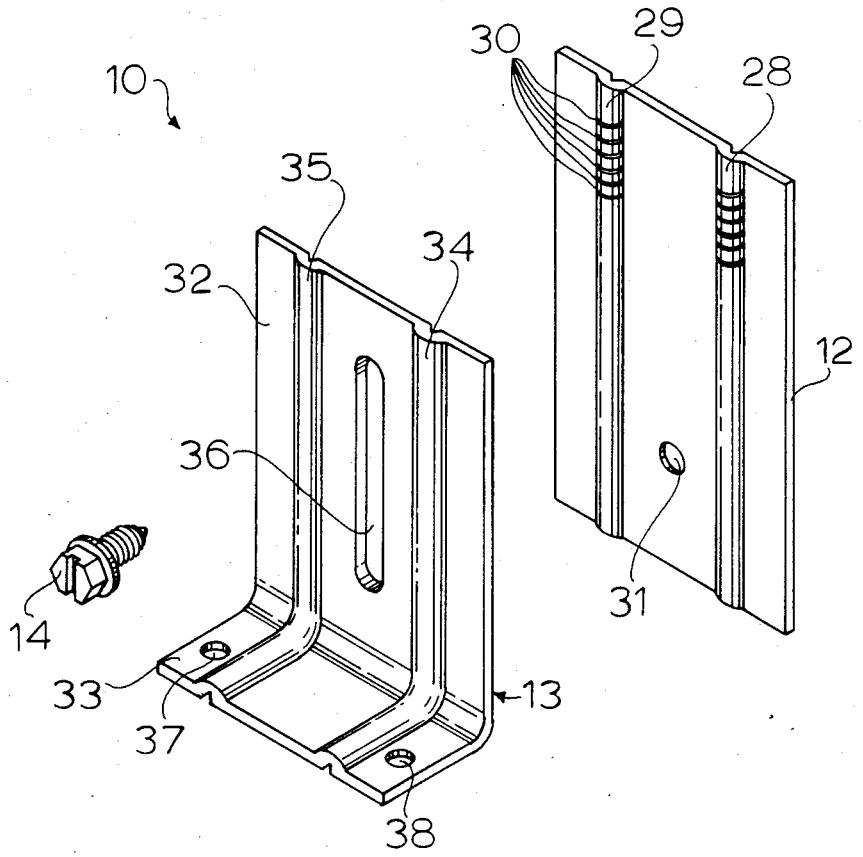
FIG. 1 is a perspective view of the adjustable metal decking support.

Although the invention is adaptable to a wide variety of uses, it is shown in the drawings for purposes of illustration as embodied in an adjustable support (10) which is attachable to a metal keyway form (11) wherein said adjustable support is comprised of a metal strip (12), a generally L-shaped support member (13) and a means (14) for securing the L-shaped support member to the metal strip. See FIG. 1.

In order to understand the invention it is important to understand the metal keyway form which is supported by the adjustable support. The adjustable support of this invention is designed to work in combination with a metal concrete joint form, for example, as disclosed in U.S. Pat. No. 4,455,104, although it can be adapted to work in combination with many other keyway forms by minor alterations well known to individuals skilled in the art.

Figure 2:
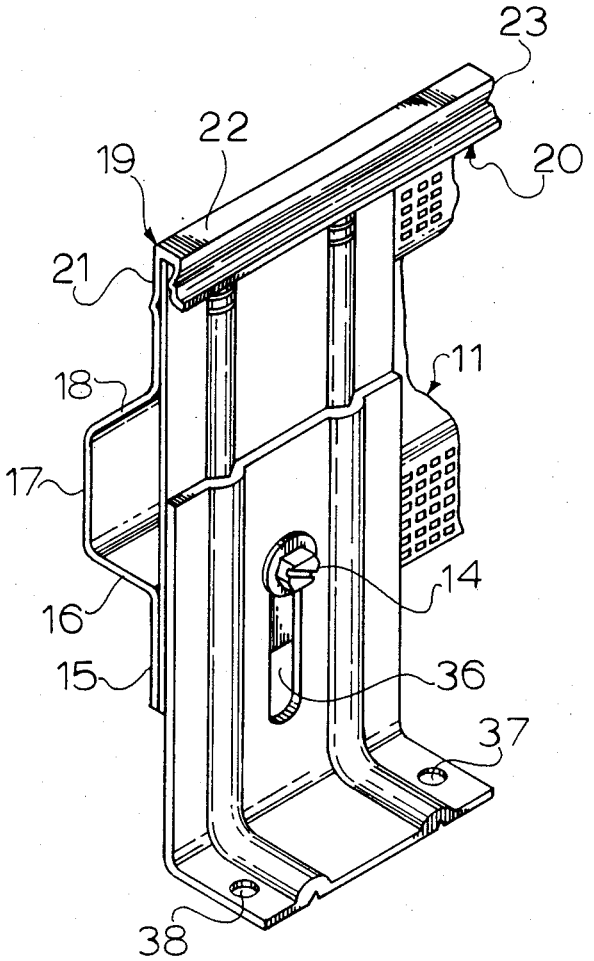
FIG. 2 is the adjustable metal decking support in attachment to a metal keyway form.
Figure 3:
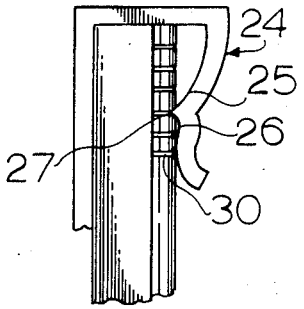
FIG. 3 is a cut away view of the adjustable metal decking support in attachment to the metal keyway form showing the slot of the keyway form in cooperation with the adjustable metal decking support.

The metal keyway form (11) is comprised of a lower lip (15), a lower side wall (16), a connecting base (17), an upper side wall (18) and an inverted hook portion (19). (See FIG. 2) The inverted hook portion forms a slot (20) with sides being an upward side (21), a flattened top edge (22) and a downturned flange (23). The lip of this downturned flange is formed into a hemmed edge (24) which is first folded inward (25) and then outward (26) to form a lip (27). (See FIG. 3)

The metal strip (12) of the adjustable support is generally a rectangular metal piece which is longer than it is wide. This metal strip contains a plurality of ridges running vertically the length of the strip. Although any number of ridges may be used, preferably two ridges are chosen (28, 29). At the top of those ridges are serrations (30) running across the ridges. (See FIG. 1) On the lower portion of the metal strip is provided a securing means opening (31) which will be discussed in detail later.

The second component of the support is a generally L-shaped support member (13) comprised of an upper leg (32) of the L-shaped support member and a lower leg (33) of the L-shaped support member. The upper leg of the L-shaped support member is provided with a plurality of valleys on the back wherein each valley aligns with a ridge on the metal strip when the L-shaped member is placed on top of the metal strip. In the preferred embodiment, two valleys (34, 35) are provided in the upper leg of the L-shaped support member to align with the two ridges in the metal strip.

Also provided in the upper leg of the L-shaped support member is an elongated vertical oval opening (36). This opening can range from about ¼ of an inch to about 4 inches in length depending on the size of the L-shaped support member and the amount of height adjustment necessary. This oval opening is located in a preferred embodiment between two valleys.

To secure the L-shaped support member to the metal strip, a securing means (14), such as a screw or bolt, runs through the elongated vertical oval opening and into the securing means opening of the metal strip. Once this securing means is tightened, the height of the adjustable metal decking support is set. By loosening this securing means, the height of the adjustable support can be adjusted. Thus, the size of the elongated vertical oval opening and the securing means opening are sufficient to allow conventional metal screws or bolts to pass through them.

The bottom leg of the L-shaped support member can optionally contain an opening (37) or a plurality of openings for securing the L-shaped support member to the metal decking. The adjustable support can be secured to the metal decking by conventional bolts, screws or by other means such as by welding.

Both the metal strip and the L-shaped support member can be produced from any sturdy heavy duty metal, such as steel, as long as it is of sufficient thickness to fit in the slot formed in the keyway forming member. The height of the adjustable support can be varied depending upon the height of the keyway form. Since conventional floors are 3, 4 or 5 inches in thickness, the adjustable support can be produced in varying heights that will allow for the pouring of floors of a set thickness.

In operation an appropriately sized adjustable support (10) is chosen to fit with the appropriate metal keyway form (11). The adjustable support is secured to metal decking by either screws or bolts running through an opening (37) in the lower leg (33) of the generally L-shaped support member or by welding it to the metal decking. The height of the adjustable support is adjusted by loosening and then tightening the securing means, (14) preferably a screw, to securely attach the metal strip (12) to the L-shaped support member (13). Once sufficient adjustable metal decking supports are secured to the metal decking, the metal keyway forms are placed over the adjustable decking. The serrations (30) of the metal strip then interact with the slot (20) of the inverted hook portion (19) of the metal keyway form (11) to prevent the upward movement of the metal keyway form while the concrete is being poured.

By this procedure metal keyway forms can be easily, accurately and quickly installed and used for the pouring of concrete floors on metal decking.

I claim:

1. An adjustable support securable to metal decking to support a metal keyway form comprising:

a. a generally flat, rectangular metal strip containing a plurality of ridges running vertically the length of the strip, a plurality of closely spaced serrations across the top portion of the ridges and a securing means opening located in the lower portion of the strip;

b. a generally L-shaped support member containing an elongated vertical oval opening and a plurality of valleys on the back of the member which align with the ridges of the metal strip; and c. a means for securing the L-shaped support member to the metal strip through the elongated vertical oval opening in the L-shaped support member and the securing means opening in the metal strip.

2. The adjustable support of claim 1 wherein the generally L-shaped support member is comprised of an upper portion which contains an upper leg of the L-shaped support member and a lower portion which contains a lower leg of the L-shaped support member.

3. The adjustable support of claim 2 wherein the lower leg of the L-shaped support member contains a plurality of openings.

4. The adjustable support of claim 1 wherein the metal strip and the L-shaped support member are produced from any sturdy, heavy-duty metal, such as steel.

5. The adjustable support of claim 1 wherein the means for securing the L-shaped support member to the metal strip is a screw or bolt running through the elongated vertical oval opening and through the securing means opening.

6. The adjustable support of claim 1 wherein there are two ridges running vertically the length of the metal strip to align with two valleys on the back of the L-shaped support member.

7. A process for the pouring of a concrete slab on metal decking to produce a keyway comprising a. securing an adjustable support to metal decking, wherein the adjustable support is comprised of a generally flat rectangular metal strip containing a plurality of ridges running vertically the length of the strip, a plurality of closely spaced serrations across the top portion of the ridges and a securing means opening located in the lower portion of the strip; a generally L-shaped support member containing an elongated vertical oval opening and a plurality of valleys on the back of the member which align with the ridges of the metal strip; and a means for securing the L-shape support member to the metal strip through the elongated vertical opening in the L-shaped support member and the securing means opening in the metal strip;

b. placing a metal keyway form containing an inverted hook portion with an inwardly facing lip onto the adjustable metal decking support and pushing the keyway form securely over the metal strip; and c. pouring concrete flush with the metal keyway form and the adjustable metal decking support.

* * * * *